US006525756B2

(12) United States Patent
Yamaguchi

(10) Patent No.: US 6,525,756 B2
(45) Date of Patent: Feb. 25, 2003

(54) HEAT-SENSITIVE RECORDING APPARATUS

(75) Inventor: Akira Yamaguchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 6 days.

(21) Appl. No.: 09/912,307

(22) Filed: Jul. 26, 2001

(65) Prior Publication Data

US 2002/0030730 A1 Mar. 14, 2002

(30) Foreign Application Priority Data

Jul. 26, 2000 (JP) ..... 2000-225211

(51) Int. Cl.[7] ..... B41J 2/335
(52) U.S. Cl. ..... 347/208
(58) Field of Search ..... 347/205, 206, 347/209, 200, 204

(56) References Cited

U.S. PATENT DOCUMENTS 5,272,489 A * 12/1993 Kobayashi et al. ..... 347/206
5,714,995 A * 2/1998 Wiklof et al. ..... 347/208
6,452,621 B1 * 9/2002 Nakamura ..... 347/208

FOREIGN PATENT DOCUMENTS

JP 10/291334 11/1998 ..... B41J/2/37

* cited by examiner

*Primary Examiner*—Lamson Nguyen
*Assistant Examiner*—K. Feggins
(74) *Attorney, Agent, or Firm*—Sughrue Mion, PLLC

(57) ABSTRACT

The heat-sensitive recording apparatus includes a thermal head in which drive power is supplied at heating elements located at both ends in the main scanning direction, and both impedances from at least one connecting portion connecting a common electrode connected to all of the heating elements to heating elements at both ends in the main scanning direction are equal to and an image processing section which, in accordance with image data, determines a current distribution within the common electrode for each of positions in the main scanning direction that correspond to the heating elements, determines amount of voltage drop due to resistance of the common electrode as a function of a position in the main scanning direction using the determined current distribution and corrects resulting density unevenness in accordance with the image data based on both the amount of voltage drop due to the resistance of the common electrode as the function of the position in the main scanning direction and the amount of voltage drop due to resistances that are independent of the position in the main scanning direction.

2 Claims, 4 Drawing Sheets

HEAT-SENSITIVE RECORDING APPARATUS

BACKGROUND OF THE INVENTION

This invention relates to the technology of heat-sensitive recording apparatus using the thermal head. The invention particularly relates to a heat-sensitive recording apparatus that can produce high-quality image by reducing the K ratio unevenness which is the unevenness in image density due to voltage drop.

Heat-sensitive recording is used as a means of recording with various types of printer, plotter, facsimile, recorder, etc. Heat-sensitive recording has various advantages such as no need for wet development and ease of handling, so its application to image recording for medical diagnoses that require large and high-quality image as in CT, MRI and X-ray imaging is currently being studied.

As is well known, heat-sensitive recording uses a thermal head having heating elements arranged in one direction (the main scanning direction); with the heat-generating portion of the thermal head slightly pressed onto the heat-sensitive material, the two members are moved relative to each other in the auxiliary scanning direction which is normal to the main scanning direction and in accordance with the image to be recorded, the heating element for each pixel is supplied with energy to generate heat so that the recording layer of the heat-sensitive material is heated to record image.

In the thermal head, the heating elements arranged in the main scanning direction each have a heat-generating resistor and a switching element and are connected parallel between a power source and the ground. Each of the switching elements are turned on and off by a signal subjected to pulse-duration modulation in accordance with the image data value (density data value) for each pixel, so that the corresponding heat-generating resistor is energized for a time period equal to the pulse duration of the modulated signal; in this way, heat-sensitive image recording by individual heat-generating resistors is controlled.

In the thermal head, the power source and the heating elements are connected by various known methods such as the use of a flexible cable. In a configuration that allows for simplified fabrication and structure at reduced cost, a common electrode to all heating elements is formed to extend in the main scanning direction via a wiring pattern and both ends of the common electrode in the main scanning direction in which the heating elements are arranged are connected to the power source (this configuration is hereunder referred to as the "both end common supply" type).

When image recording is done by this thermal head, voltage drop proportional to the current flow through the thermal head occurs on account of various resistances including the internal resistance of the power source, wiring resistances such as the one of the power cable extending from the power source to the thermal head, and the pattern resistance or the resistance of the wiring pattern in the thermal head. Since the current flow through the thermal head varies with the image data, the amount of the voltage drop varies with the data for the image to be recorded. The amount of voltage drop that occurs in the thermal head also varies with the resistance of the wiring pattern as a function of the position in the main scanning direction.

As a result, the heat-sensitive recording apparatus using the thermal head undergoes variations in the supply voltage to each of the heating elements, causing a problem generally referred to as "K ratio unevenness", which is the density difference that occurs in the actual recorded image despite the sameness of the image data.

To correct the K ratio unevenness, it has been attempted to calculate the average voltage drop per line or the voltage drop in each heating element and compensate for the loss of thermal energy due to the voltage drop. However, the K ratio unevenness cannot be adequately corrected by this method since it is incapable of dealing with the difference in the amount of voltage drop that occurs from the pattern resistance as a function of the position in the main scanning direction.

To deal with this situation, the assignee previously developed an algorithm for correcting the K ratio unevenness according to which the distribution of voltage drop in the wiring pattern as a function of the position in the main scanning direction was calculated on the basis of image data and on each heating element, multiplication by a correction factor as determined by the calculated distribution of voltage drop was performed; the assignee proposed this algorithm in a patent application (see Unexamined Published Japanese Patent Application (JPA) No. 291334/1998). According to this correcting algorithm, the K ratio unevenness can be effectively corrected in spite of the difference in the amount of voltage drop occurring as a function of the position in the main scanning direction and it is possible to produce image of better quality than in the prior art.

However, this technique sometimes fails to achieve satisfactory correction of the K ratio unevenness that occurs to the thermal head of the aforementioned "both end common supply" type and further improvements are to be made.

SUMMARY OF THE INVENTION

The present invention has been accomplished under these circumstances and has as an object providing a heat-sensitive recording apparatus that uses a thermal head of the "both end common supply" type using a common electrode to all heating elements, with it being connected to the power source such that drive power is supplied to it at both ends in the main scanning direction in which the heating elements are arranged, and which ensures that image deterioration due to K ratio unevenness is prevented in a more efficient and positive way to record image of better quality that is free from any density unevenness.

In order to attain the object described above, the present invention provides a heat-sensitive recording apparatus comprising: a thermal head having a plurality of heating elements arranged in a main scanning direction, a common electrode connected to all of the heating elements, and at least one connecting portion which connects the common electrode to a power source such that drive power is supplied at the heating elements located at both ends in the main scanning direction, wherein the common electrode is such that impedance from the at least one connecting portion to a heating element at one end in the main scanning direction is equal to impedance from the at least one connecting portion to a heating element at the other end in the main scanning direction; and an image processing section which, in accordance with image data, determines a current distribution within the common electrode for each of positions in the main scanning direction that correspond to the heating elements, the image processing section using the determined current distribution to determine amount of voltage drop due to resistance of the common electrode as a function of a position in the main scanning direction, and correcting resulting density unevenness in accordance with the image data based on both the amount of voltage drop due to the resistance of the common electrode as the function of the position in the main scanning direction and the amount of voltage drop due to resistances that are independent of the position in the main scanning direction.

Preferably, the at least one connecting portion has a plurality of the connecting portions and wherein the impedance from the power source to one connecting portion is equal to the impedance to another connecting portion.

DETAILED DESCRIPTION OF THE INVENTION

The heat-sensitive recording apparatus of the invention is now described below with reference to the preferred embodiments shown in the accompanying drawings.

Figure 1:
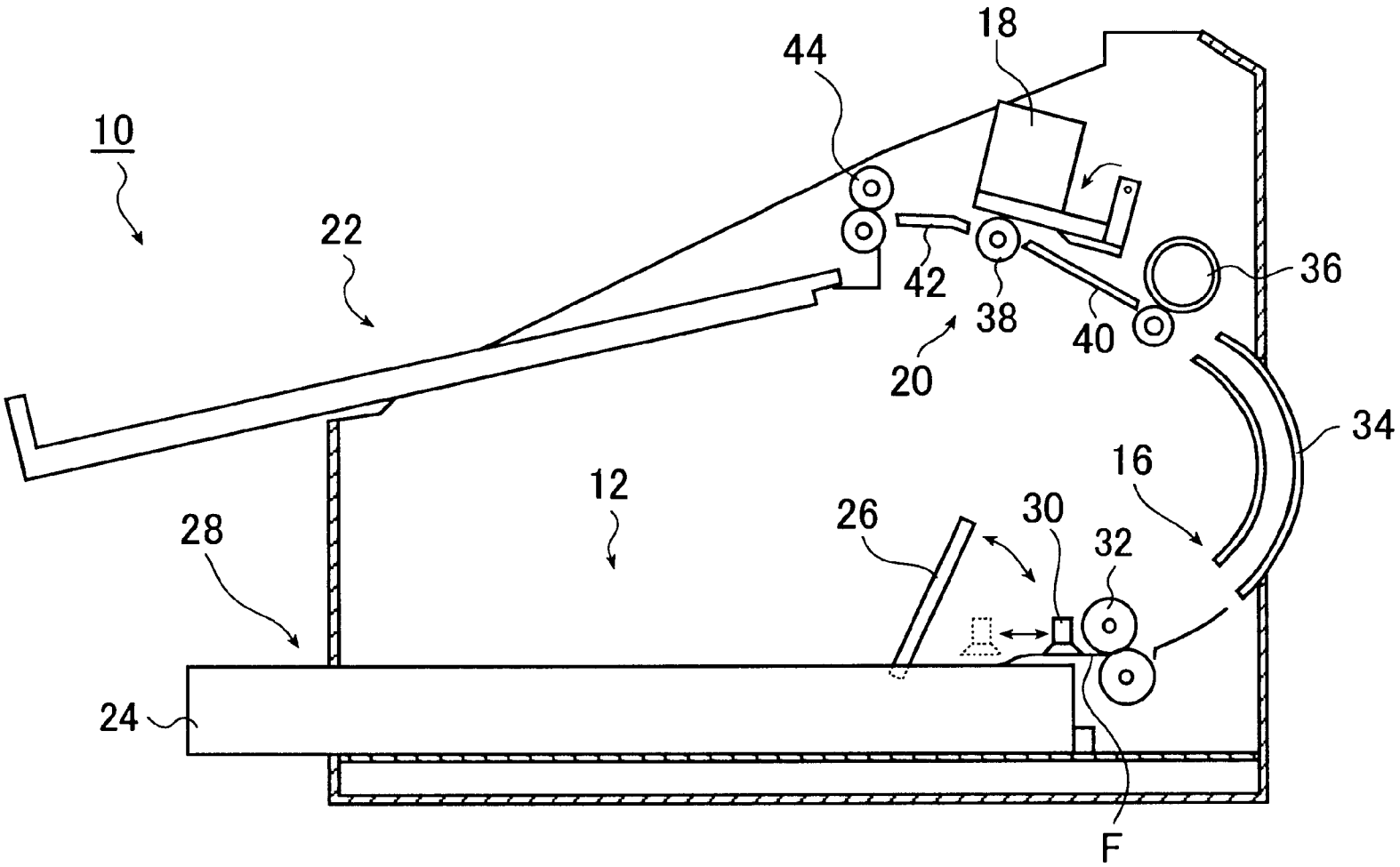
FIG. 1 shows an example of the heat-sensitive recording apparatus of the invention in conceptual form.

FIG. 1 is a sectional view showing an example of the heat-sensitive recording apparatus of the invention in conceptual form.

The heat-sensitive recording apparatus generally indicated at 10 is intended to perform thermal image recording on heat-sensitive materials such as a heat-sensitive film F (hereunder referred to as film F) of a specified size such as 14×17" size. The heat-sensitive recording apparatus 10 consists essentially of a loading section 12, a feed/transport section 16, a recording section 20 that uses a thermal head 18 to perform thermal image recording on film F, and an ejection tray 22.

Film F typically uses a transparent poly(ethylene terephthalate) (PET) base and has a heat-sensitive recording layer formed on one side. A specified number of films F, say about 100 films, are stacked in a dedicated magazine 24. The magazine 24 having a cover 26 is slid inside the apparatus 10 through a slot 28 and positioned in the loading section 12 by known means such as the use of guides and stoppers.

The feed/transport section 16 picks up one of the films F from the magazine 24 in the loading section 12 and transports it to the recording section 20. The feed/transport section 16 has basically a sheet feeding mechanism using suckers 30 that suck the film F to be held in position, a transport roller pair 32, a transport guide 34, a cleaning roller pair 36, and an opening/closing mechanism (not shown).

When the heat-sensitive recording apparatus 10 receives a command to start recording, the opening/closing mechanism (not shown) opens the cover 26 of the magazine 24, from which one film F is picked up by the suckers 34 and fed into the transport roller pair 32. The film F is then moved past the transport guide 34 and fed into the cleaning roller pair 36, the upper member of which removes any dirt and dust from the recording surface of the film F before it is transported into the recording section 20. When all the films F that are to be subjected to recording have been ejected from the magazine 24, the aforementioned opening/closing mechanism will close the cover 26.

The recording section 20 has basically a thermal head 18, a platen roller 38, transport guides 40 and 42, an ejection roller pair 44, and a fan (not shown) that is used to cool the thermal head 18.

The thermal head 18 is intended to perform thermal image recording at a (pixel) density of, say, 300 dpi and it comprises a body having a glaze and a heat sink fixed to the body; the glaze has a plurality of heating elements arranged in one direction (the main scanning direction which is normal to the paper on which FIG. 1 is drawn).

While keeping the film F in a specified position, the platen roller 38 rotates at a specified speed so that the film F as held between the thermal head 18 (glaze) and the platen roller 38 is transported at a specified recording speed in the auxiliary scanning direction normal to the main scanning direction.

The film F emerging from the cleaning roller pair 36 is moved past the transport guide 40 and transported as it is held between the platen roller 38 and the thermal head 18, with the glaze being slightly pressed.

In parallel with this film transport, the thermal head 18 drives each of the hating elements in accordance with the image data (image to be recorded), whereby the associated heat-generating resistor is heated and the film F accordingly develops color by thermal development to record image.

The image carrying film F is moved past the transport guide 42 to be fed into the ejection roller pair 44, from which it is ejected into the ejection tray 22 as an image-carrying hard copy.

Figure 2:
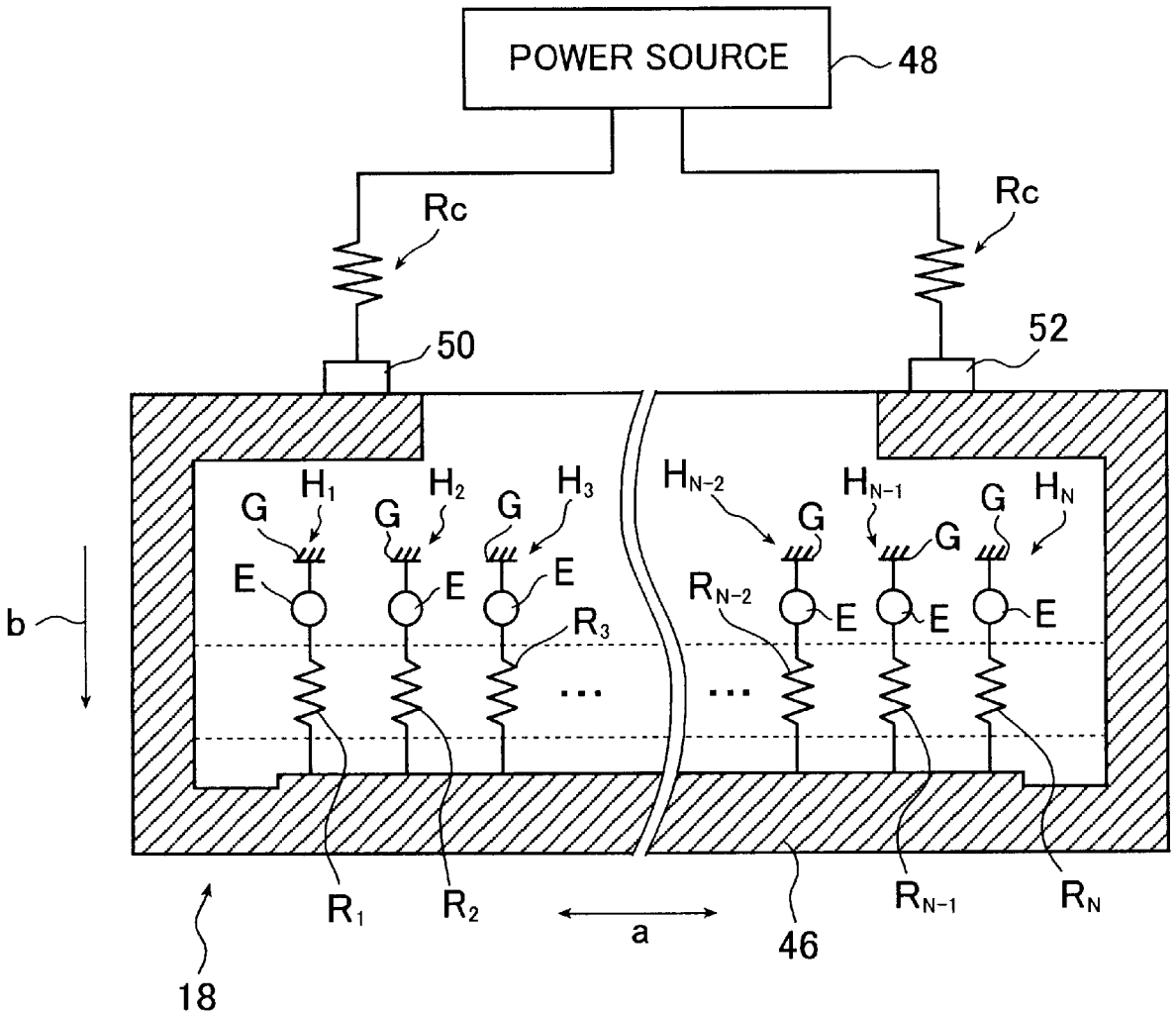
FIG. 2 shows conceptually a wiring diagram for an example of the thermal head to be used in the heat-sensitive recording apparatus shown in FIG. 1.

FIG. 2 is a wiring diagram showing the thermal head 18 in conceptual form. The thermal head 18 is of the "both end common supply" type which has a common electrode to all heating elements that is connected to the power source in such a way that drive power is supplied at the heating elements located at both ends in the main scanning direction.

In the illustrated case, the thermal head 18 has a common wiring pattern 46 formed around the body except in a portion of the area upstream in the auxiliary scanning direction. The common wiring pattern 46 which is hatched in FIG. 2 constitutes the common electrode and is hereunder referred to simply as the common pattern 46.

Heating elements H are of a type that is used in known thermal heads and they each consist of a heat-generating resistor R and a switching element E such as IC; N heating elements $H_1$–$H_N$ are arranged in the main scanning direction (indicated by arrow a) as they are connected parallel between the common pattern 46 (i.e., power source 48) and the ground G. The auxiliary scanning direction is indicated by arrow b and the glaze is formed near the area indicated by the dashed lines.

Near the peripheral area of the thermal head 18 where the common pattern 46 is not formed (i.e. near both ends of the continuous stretch of the common pattern 46 in the main scanning direction), there are provided two connectors 50 and 52 that connect the common pattern 46 to the power source 48, thereby making the thermal head 18 of the "both end common supply" type.

In the heat-sensitive recording apparatus 10 of the invention, the thermal head 18 is such that the common electrode has the same impedance as calculated for the area from the connection between the power source and the common electrode to the heating element at one of its ends in the main scanning direction and for the area from the connection to the heating element at the other end (for convenience sake, this design is hereunder described as "the common impedance being symmetrical in the main scanning direction").

Referring to FIG. 2, the impedance of the common pattern 46 from connector 50 to heating element $H_1$ is equal to that from connector 52 to heating element $H_N$. In the illustrated case, the common pattern 46 is formed symmetrical with respect to the center line, or the line that runs in the auxiliary scanning direction through the center between heating elements $H_1$ and $H_N$ in the main scanning direction, and connectors 50 and 52 are arranged in symmetry with respect to this center line; by meeting these requirements, the common impedance is made symmetrical in the main scanning direction.

As will be described later, this design allows for more efficient correction of the K ratio than in the prior art, thereby enabling the recording of thermal image of better quality that is free from the K ratio unevenness.

It should be noted that the foregoing is not the sole design for the structure of the thermal head 18 in the heat-sensitive recording apparatus 10 of the invention and various other designs can be adopted as long as the common impedance is symmetrical in the main scanning direction. For example, the common pattern constituting the common electrode may be formed in the entire periphery of the thermal head and connected to the power source via a single connector.

If, as in the illustrated case, the thermal head has a plurality of connections between the power source and the common electrode, the cables running from the power source to the respective connections have preferably the same impedance. In a preferred embodiment of the case shown in FIG. 2 having two connectors 50 and 52, the impedance Rc of the cable between the power source 48 and the connector 50 is equal to the impedance Rc of the cable between the power source 48 and the connector 52. This design allows for more efficient correction of the K ratio.

As already mentioned, in the heat-sensitive recording apparatus 10, the film F is transported as it is held between the platen roller 38 and the thermal head 18 (glaze) and in accordance with image data, each of the heating elements H in the thermal head 18 is driven to heat the associated heat-generating resistor R, thereby performing thermal recording on the film F.

Figure 3:
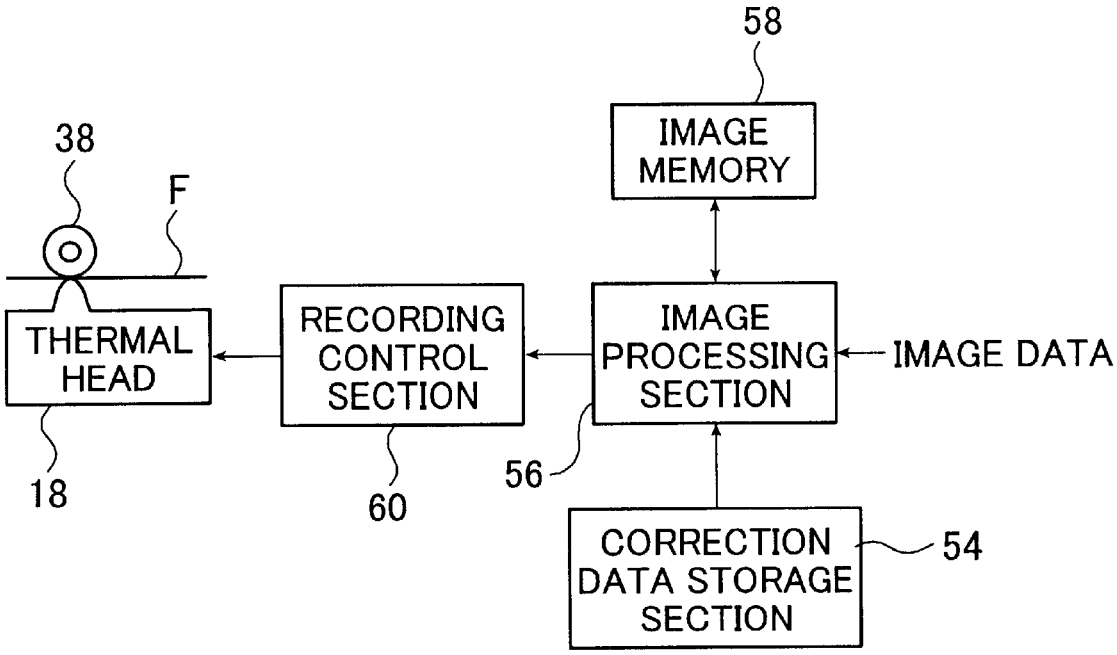
FIG. 3 is a simplified block diagram for an example of the image data processing system in the heat-sensitive recording apparatus shown in FIG. 1.

In the illustrated case of heat-sensitive recording apparatus 10, thermal recording in accordance with image data is typically controlled by the image data processing system shown in FIG. 3.

In the illustrated case, the image data processing system comprises a correction data storage section 54 that holds various kinds of data for correcting image data, an image processing section 56 which performs various kinds of image processing on the image data including corrections such as one of K ratio, an image memory 58 for holding the image processed image data, and a recording control section 60 which controls the thermal head 18 (switching elements E) on the basis of the image data stored in the image memory 58.

In the image data processing system, the correction data storage section 54 holds not only K ratio correction data for correcting the K ratio unevenness in accordance with the image data but also various other kinds of correction data for performing such corrections as shading correction (correction of the density unevenness due to thermal head 18), sharpness correction (for edge enhancement), gradation correction (correction according to the □ value of heat-sensitive material A and the like), temperature correction (for adjusting the energy of heat generation according to the temperature of each heat-generating resistor) and resistance correction (for correcting the impedance difference between heat-generating resistors).

The image data to be used in image recording is supplied into the image processing section 56 from an image input apparatus such as CT or MRI apparatus and on the basis of the aforementioned various kinds of correction data stored in the correction data storage section 54, the image data in the image processing section 56 is subjected to various kinds of image processing including not only K ratio correction but also shading correction, sharpness correction, gradation correction, temperature correction and resistance correction.

The K ratio correction to be performed in the image processing section 56 not only compensates for the voltage drop due to resistances that are independent of the position in the main scanning direction, it also intends to compensate for the energy loss due to voltage drop that varies with the position in the main scanning direction; to this end, the current distribution as a function of the position in the main scanning direction is determined in accordance with image data and with this current distribution, the amount of voltage drop in each position in the main scanning direction is determined, and on the basis of the thus determined amounts of voltage drop due to resistances in the various positions in the main scanning direction, as well as the amounts of voltage drops that are independent of the position in the main scanning direction, one corrects the K ratio unevenness that occurs in accordance with the image data. A specific procedure for correcting the K ratio unevenness is as follows. For further details of the K ratio correction, see commonly assigned JPA No. 291334/1998, supra.

As already noted, the K ratio unevenness results from voltage drops that occur not only from the internal resistance of the power source and the wiring resistances such as one of the power cable from the power source to the thermal head but also from the pattern resistance, or the resistance of the wiring pattern within the thermal head.

Normally, the supply voltage V is much greater than voltage drop Vd (V>>Vd). If the impedance of a heating element is written as R, the change in the energy of heat generation Ed from the thermal head that occurs on account of voltage drop Vd is expressed by:

$$Ed=(2V/R)\times Vd \quad (1)$$

It is therefore clear that by determining the voltage drop Vd, one can correct the change in the energy of thermal generation Ed.

The amount of voltage drop in each heating element also changes with the number of other heating elements being driven. Therefore, in the case of pulse-duration modulation (or pulse-numbers modulation), the amount of voltage drop in each heating element is not always constant in one line but varies per unit time which corresponds to one level of gradation. It is therefore necessary to take into account the possibility that the amounts of both electric current and voltage drop will change in one line.

Figure 4:
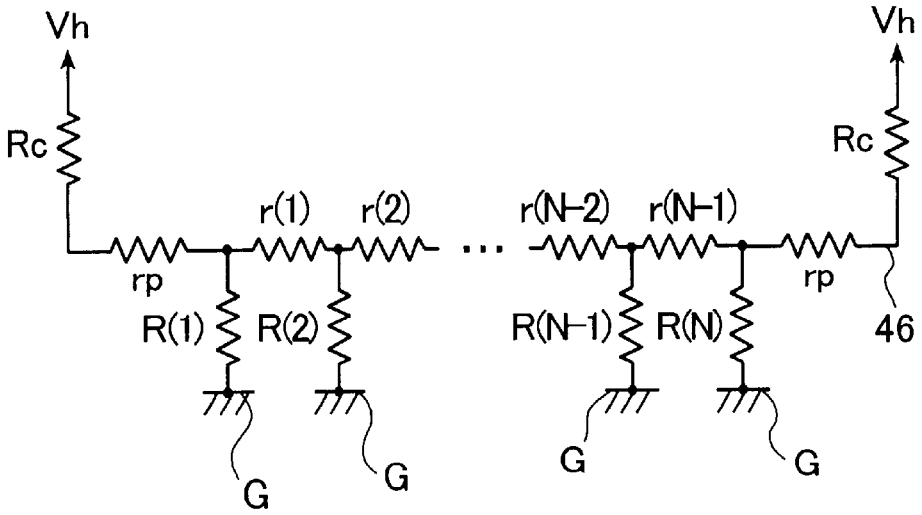
FIG. 4 shows conceptually an example of the equivalent circuit for the thermal head shown in FIG. 2.

FIG. 4 shows an equivalent circuit for the thermal head 18. As already mentioned, drive power Vh is supplied to the common pattern 46 at sites near its ends and N heat-generating resistors R are connected between the common pattern 46 and the ground G. In FIG. 4, the resistance as measured between the power source and each connector is written as Rc, the impedance between each connector and the heating element H at an end as rp, the impedance of heat-generating resistor Rx in position x in the main scanning direction (for heating element H and common pattern 46 adjacent on the side where N assumes the greater value) as R(x) [R(1), R(2), . . . R(N-1), R(N)], and the impedance of common pattern 46 in position x as r(x) [r(1), r(2), . . . , r(N-2), r(N-1)].

If the current flowing through the heat-generating resistor Rx in position x is written as $I_h(x)$, the current Ip(x) flowing through the common pattern 46 in position x is determined by the following equation (2):

$$Ip(x) = \int_0^x I_h(x)\,dx \tag{2}$$

The voltage drop Vp(x) due to the impedance r(x) of common pattern 46 in position x is determined by the following equation (3):

$$Vp(x) = \int_0^x Ip(x)\cdot r(x)\,dx \tag{3}$$

As already mentioned, the impedance between one connector and the heating element at one end of the common pattern is rp and equal to the impedance between the other connector and the heating element at the other end. Therefore, the potential difference between heat-generating resistors R(1) and R(N) at opposite ends of the thermal head 18 in the main scanning direction is zero and electric current is supplied at both ends. As a result, the current Ih(x) makes a negative shift by a constant b ("negative" means the current is supplied from the left side of FIG. 4).

Therefore, the voltage drop Vp(x) due to the impedance r(x) of common pattern 46 in position x is determined by the following equation (4):

$$\begin{aligned} Vp(x) &= -\int_0^x (Ip(x) - b)\cdot r(x)\,dx \\ &= -\int_0^x Ip(x)\cdot r(x)\,dx + \int_0^x b\cdot r(x)\,dx \end{aligned} \tag{4}$$

If the common pattern 46 has an overall length of X, constant b is determined by:

$$b = \frac{\int_0^x Ip(x)\cdot r(x)\,dx}{\int_0^x r(x)\,dx}$$

On the other hand, the voltage drop $V_1$ due to position (x) independent impedances such as the internal resistance of the power source and the wiring resistance is determined by the following equation (5):

$$V_1 = r_1 x\, I_p(X) \tag{5}$$

In the heat-sensitive recording apparatus 10 of the invention which operates on equation (1), the total amount of voltage drops $[V_1+V_p(x)]$ that is determined by the above calculations is multiplied by a correction constant k and the product is added to the initial image data, thereby performing the correction of K ratio.

A specific corrective procedure is shown below, in which the following factors are considered in addition to the impedances R(x) and r(x) shown in FIG. 4: the initial image data D(x) in position x in the main scanning direction; as corrected image data $D_h(x)$, position (x) independent impedances $r_1$ such as the internal resistance of power source 48 and the wiring resistance, the number of heating elements N, the corrective constant k, dummy image data d(x) to provide fast enough response to the temporal change in electric current, the amount of voltage drop C(x), and the dummy variable C'(x) for effecting K ratio correction on a corrective value.

STEP 1

First, substitute the initial value of image data D(x) into the dummy image data d(x) and adjust the dummy variable C'(x) to zero as indicated below:

d(x)=D(x)

C'(x)=0 where x is an integer between 1 (inclusive) and N (inclusive).

STEP 2

The current $I_h(x)$ flowing through each heat-generating resistor Rx is in inverse proportion to R(x), so on the basis of equations (2) and (3), the current in each position x in the main scanning direction (i.e. the current distribution within the wiring pattern as a function of the position in the main scanning direction) and the position (x) dependent voltage drop are determined for each unit time equal to the pulse duration of one gradation level (in the case of pulse-duration modulation); thereafter, one (1) is subtracted from d(x) in order to provide fast enough response to the temporal change of current for each unit time:

$$I(x) = \sum_{i=1}^{x} I_h(i)\times\delta(i)$$

$$\text{Where } \delta(i) = \begin{cases} 1 & d(i) \geqq 1 \\ 0 & d(i) \leqq 0 \end{cases}$$

$$V(1) = 0$$

$$V(x) = \sum_{i=1}^{x-1} I(i)\times r(i) \quad (\text{When } 2 \leqq x \leqq N)$$

$$rx(1) = 0$$

$$rx(x) = \sum_{i=1}^{x-1} r(i) \quad (\text{When } 2 \leqq x \leqq N)$$

$$d(x) \leftarrow d(x) - 1$$

In the above calculations, δ (i) takes the value "one" if the dummy image data d(i) is at least one and an electric current flows through the heat-generating resistor Ri. This means the cumulative addition of the current $I_h(i)$ flowing through the heat-generating resistor Ri. Conversely, if the dummy image data d(i) is no greater than zero and there is no current flowing through the heat-generating resistor Ri, δ (i) takes the value "zero", meaning no cumulative addition of $I_h(i)$.

STEP 3

On the basis of equations (4) and (5), the amount of voltage drop C(x) is determined by the following equation:

$$C(x) = -V(x) + (V(X)/r(x))\times r(x) + r_1\, x\, I(X)$$

STEP 4

When either one of the values of d(x) is zero in step 2, or when current application to the heat-generating resistor Rx ends and there is no more voltage drop occurring in position x, the following calculation formulae are used to update the dummy image data d(x) and dummy variable C'(x):

$$d(x) \leftarrow d(x)+k \times (C(x)-C'(x))$$

$$C'(x)=C(x)$$

As a result, the amount of voltage drop C(x) which is a corrective value can also be corrected for K ratio.

STEP 5

Steps 2, 3 and 4 are repeated until all values of d(x) are zero or below. Finally, the amount of voltage drop C(x) in position x according to the image data is determined and used to correct the image data in accordance with the following equation:

$$D_h(x)=D(x)+k\ x\ C(x)$$

The calculations described above are so voluminous (the number of gradations levels N times the total number of pixels) that they require a very long time to complete.

The volume of calculations can be significantly reduced to shorten the calculation time by neglecting the temporal change in current distribution $I_p(x)$ and taking the calculation procedure set forth below, which involves the following additional parameters: M, the number of gradations levels of each pixel; C(j), voltage drop correction coefficient for each gradation level j; I(x), current in position x; V(x), voltage drop in position x; hst(j), the number of pixels in one line which have the image data value of j.

STEP 1

First, adjust each of I(x), V(x) and hst(j) to the initial value "zero" as indicated by the following equations:

$$I(x)=0$$

$$V(x)=0$$

$$hist(j)=0$$

where x is an integer between 1 (inclusive) and N (inclusive), and j is an integer between 0 (inclusive) and M (inclusive).

STEP 2

Determine I(x), V(x) and hst(j) by the following calculation formulae, provided that δ (j,D(i)) takes the value "one" if the image data value D(i) is equal to the image data value j and takes the value "zero" if D(i) is not equal to j:

$$(x) = \sum_{i=1}^{X} \frac{1}{R(i)} \cdot D(i)$$

$$V(1) = 0$$

$$V(x) = \sum_{i=1}^{x-1} I(i) \cdot r(i) \quad (\text{When } 2 \leqq x \leqq N)$$

$$rx(1) = 0$$

$$rx(x) = \sum_{i=1}^{x-1} r(i) \quad (\text{When } 2 \leqq x \leqq N)$$

$$hst(j) = \sum_{i=1}^{X} \frac{1}{R(i)} \cdot \delta(j, D(i))$$

-continued $$\text{Where } \delta(j, D(i)) = \begin{cases} 1 & j = D(i) \\ 0 & j \neq D(i) \end{cases}$$

STEP 3

Determine the corrective values for the respective values of image data as follows:

$$S(M)=0$$

$$C(M)=1(x)$$

$$S(M\text{-}1)=S(M)+\text{hst}(M)$$

$$C(M\text{-}1)=C(M)-S(M\text{-}1)$$

$$S(M\text{-}2)=S(M\text{-}1)+hst(M\text{-}1)$$

$$C(M\text{-}2)=C(M\text{-}1)-S(M\text{-}2)$$

:

:

$$S(1)=S(2)+hst(2)$$

$$C(1)=C(2)-S(1)$$

STEP 4

Use the following equation to calculate the amount of voltage drop V(x) due to the impedance of common pattern 46 in position x within the thermal head:

$$V(x)=-V(x)=(V(X)/r(X))x\ r(x)$$

STEP 5

Finally, correction is performed by the following formula:

$$D_h(x)=D_h(x)+C(D(x))x\ k\ x(k_p x\ V(x)+1)$$

where $k_p$ is the proportion of the pattern resistance, or the resistance of the wiring pattern in the thermal head, as relative to the position (x) independent resistances such as the internal resistance of the power source and the wiring resistance.

If the corrective value is so large that it is necessary to consider the voltage drop that may result from this corrective value, the respective image data for one line are corrected in accordance with the following formula, assuming that the frequency of correction of the corrective value C(j) determined in step 3 is the same as that of the corrective value to be applied to the initial image data:

$$D_h(x)=D_h(x)+C(D(x))x\ k\ x(k_p \times V(x)+1)\ x(1+(C(D(x))x\ k\ x(k_p \times V(x)+1))/D_h(x))$$

If the heat-generating resistors Rx in the heat-sensitive recording apparatus 10 have negligibly small variations in impedance R(x) and if the common pattern 46 also has negligibly small variations in impedance r(x), the above-described methods of correcting the K ratio may be performed by assuming each of these impedances to be constant.

According to the aforementioned methods of K ratio correction, the unevenness in K ratio can be corrected in the image processing section 56 as appropriate for specific image data on the basis of the voltage drop due not only to resistances such as the internal resistance of the power source and the wiring resistance that are independent of the position in the main scanning direction but also to the impedance within the common pattern 46 in the thermal head 18.

However, as already mentioned, those methods sometimes fail to achieve the desired K ratio correction if they are applied to the thermal head 18 of the both end common supply type.

The present inventors made intensive studies on this failure and found that the primary reason was the difference in drive energy between heating elements at opposite ends of the common pattern in the main scanning direction.

Figure 5A:
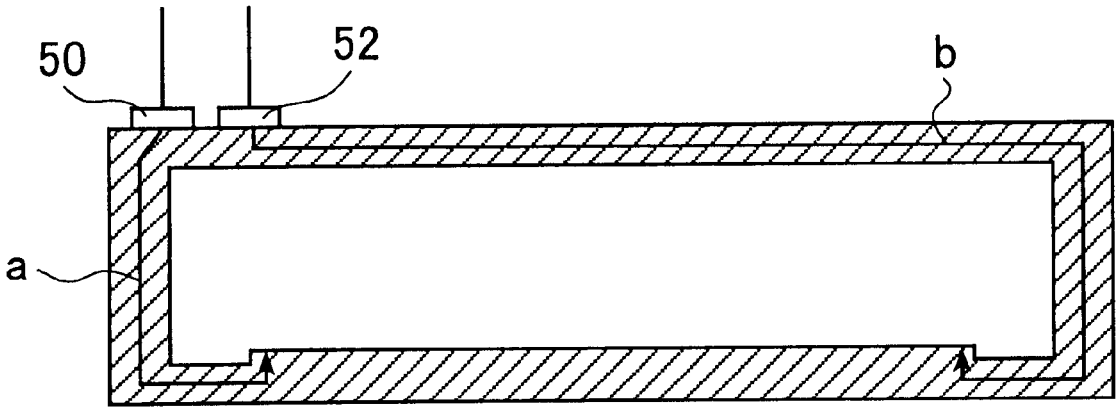
FIG. 5A shows a wiring circuit for a conventional thermal head in conceptual form.

Consider, for example, a thermal head of the both end common supply type which has a common pattern as shown hatched in FIG. 5A, with two connectors 50 and 52 provided on the left side. Obviously, the current path a from connector 50 to the heating element at the left end is shorter than the current path b from connector 52 to the heating element at the right end, so path b has greater impedance, suffers greater voltage drop and hence provides smaller drive energy than path a.

Figure 5B:
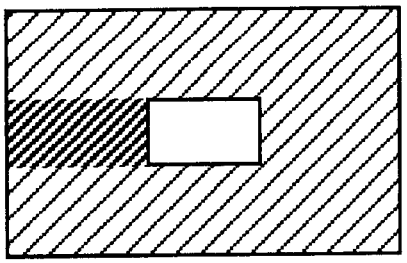
FIG. 5B shows in conceptual form an image that has been recorded with the conventional thermal head.

Therefore, if the above-described method of K ratio correction is applied as referenced to the heating element at the right end, overcorrection occurs on the left side and in the case of recording an image having a rectangular clear spot in an area of uniform high density (solid image), a stretch of undesirably high-density zone appears to the left of the clear spot as shown in FIG. 5B.

Figure 5C:
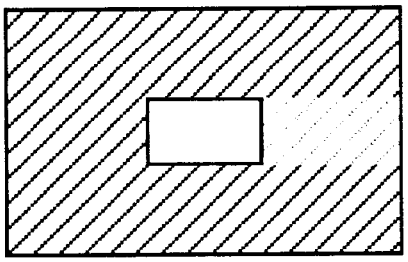
FIG. 5C shows in conceptual form another image that has been recorded with the conventional thermal head.

Conversely, if the above-described method of K ratio correction is applied as referenced to the heating element at the left end, undercorrection occurs on the right side and in the case of recording the same image as mentioned above, a stretch of undesirably low-density zone appears to the right of the clear spot as shown in FIG. 5C.

To eliminate these difficulties, the heat-sensitive recording apparatus of the invention is so designed that common impedance is symmetrical in the main scanning direction and, if it has a plurality of connectors as shown in FIG. 2, the impedance from the power source to one connector is made equal to the impedance to another connector.

Therefore, according to the present invention, uniform drive energy can be supplied to the heating elements at both ends in the main scanning direction of a thermal head of the both end common supply type and this helps the aforementioned methods of K ratio correction exhibit their intended advantages fully. Even if there occurs a significant voltage drop due to the pattern resistance, or the resistance of the wiring pattern in the thermal head, K ratio is appropriately corrected to enable the thermal recording of high-quality image that is free from density unevenness due to uneven K ratio.

Turning back to the heat-sensitive recording apparatus 10, image data that has been subjected to K ratio correction and various other kinds of image processing in the image processing section 56 is stored in the image memory 58.

The processed image data is then read out of the image memory 58 and fed into the recording control section 60, where on the basis of the image data stored in the image memory 84, each of the heating elements H (switching elements E) in the thermal head 18 is driven, so that the associated heat-generating resistor R generates the appropriate amount of heat to perform thermal recording on the film F in accordance with the corrected image data.

The film F now carrying the thermal image is further transported by the platen roller 38 and moved past the transport guide 42 to be fed into the ejection roller pair 44, from which it is ejected into the ejection tray 22 as a hard copy with the recorded image.

While the heat-sensitive recording apparatus of the invention has been described above in detail, it should be noted that the invention is by no means limited to the foregoing embodiments and various improvements and modifications can of course be made without departing from the scope and spirit of the invention.

As described above in detail, the heat-sensitive recording apparatus of the invention uses a thermal head of the both end common supply type and can still perform efficient K ratio correction to output high-quality image that is free from density unevenness due to uneven K ratio.

What is claimed is:

1. A heat-sensitive recording apparatus comprising:

a thermal head having a plurality of heating elements arranged in a main scanning direction, a common electrode connected to all of the heating elements, and at least one connecting portion which connects said common electrode to a power source such that drive power is supplied at the heating elements located at both ends in said main scanning direction, wherein said common electrode is such that impedance from said at least one connecting portion to a heating element at one end in said main scanning direction is equal to impedance from said at least one connecting portion to a heating element at the other end in said main scanning direction; and an image processing section which, in accordance with image data, determines a current distribution within said common electrode for each of positions in the main scanning direction that correspond to said heating elements, said image processing section using the determined current distribution to determine amount of voltage drop due to resistance of said common electrode as a function of a position in said main scanning direction, and correcting resulting density unevenness in accordance with said image data based on both the amount of voltage drop due to the resistance of said common electrode as the function of the position in said main scanning direction and the amount of voltage drop due to resistances that are independent of the position in said main scanning direction.

2. The heat-sensitive recording apparatus according to claim 1, wherein said at least one connecting portion has a plurality of said connecting portions and wherein the impedance from the power source to one connecting portion is equal to the impedance to another connecting portion.

* * * * *